US010641470B1

(12) United States Patent
Smyth

(10) Patent No.: US 10,641,470 B1
(45) Date of Patent: May 5, 2020

(54) LIGHT STRANDS BRACKET DEVICE AND SYSTEM

(71) Applicant: David Smyth, Palmetto Bay, FL (US)

(72) Inventor: David Smyth, Palmetto Bay, FL (US)

( * ) Notice: Subject to any disclaimer, the term of this patent is extended or adjusted under 35 U.S.C. 154(b) by 0 days.

(21) Appl. No.: 15/859,308

(22) Filed: Dec. 29, 2017

(51) Int. Cl.

| | |
|---|---|
| ***F21V 21/116*** | (2006.01) |
| ***F21V 21/08*** | (2006.01) |
| *F21W 121/04* | (2006.01) |
| *F21Y 115/10* | (2016.01) |
| *F21Y 113/13* | (2016.01) |
| *F21W 121/00* | (2006.01) |

(52) U.S. Cl.
CPC ..... *F21V 21/116* (2013.01); *F21V 21/0816* (2013.01); *F21V 21/0832* (2013.01); *F21W 2121/00* (2013.01); *F21W 2121/04* (2013.01); *F21Y 2113/13* (2016.08); *F21Y 2115/10* (2016.08)

(58) Field of Classification Search
CPC ..... F21V 21/116; F21V 21/0816; F21V 21/0832; F21W 2121/00; F21W 2121/04; F21Y 2113/13; F21Y 2115/10
See application file for complete search history.

(56) References Cited

U.S. PATENT DOCUMENTS 4,244,014 A * 1/1981 Van Ess ..... F21V 21/0832 362/249.01
4,852,832 A * 8/1989 Delaney ..... F16L 3/08 248/65
5,639,157 A * 6/1997 Yeh ..... F21S 4/10 362/123
5,695,273 A * 12/1997 Lanning ..... B44C 5/00 248/68.1
6,062,701 A * 5/2000 Hines ..... A47G 33/06 362/123
6,224,231 B1 * 5/2001 Personius ..... F21V 19/04 362/123
10,092,124 B1 * 10/2018 Tsai ..... A47G 33/06
2002/0105803 A1 * 8/2002 Deutsch ..... F21V 21/108 362/145
2005/0276067 A1 * 12/2005 Risch ..... F21V 21/08 362/567
2007/0008724 A1 * 1/2007 Raska ..... F21S 4/10 362/249.16

* cited by examiner

*Primary Examiner* — Evan P Dzierzynski
(74) *Attorney, Agent, or Firm* — Lhota and Associates P.A.; David Lhota

(57) ABSTRACT

A decorative lighting device and process for mounting method the lighting device on curved or cylindrical surfaces or support structures, such as tree trunks, columns and poles, the lighting device including a system of light strands mounted to at least two brackets at opposite ends of the light strands, and preferably multiple intermediate brackets along the length of the strands between the end brackets, wherein the strands are connected to the brackets by fasteners, such as ties, tie wraps or staples with a first predetermined distance between the fasteners and a second predetermined distance between the light strands, and the brackets are positioned laterally with respect to the strands and spaced apart a third predetermined distance. The brackets may be made of plastic or wood and have predetermined dimensions. The light strands include a plurality of light sources, preferably LED's, that may be a single color or different colors.

20 Claims, 3 Drawing Sheets

LIGHT STRANDS BRACKET DEVICE AND SYSTEM

CROSS-REFERENCE TO RELATED APPLICATION

N/A

STATEMENT REGARDING FEDERALLY SPONSORED RESEARCH OR DEVELOPMENT

N/A

FIELD OF THE INVENTION

The present invention relates to decorative light strands, such as Christmas lights, and in particular, to a light strands bracket system having a plurality of light strands supported by a plurality of brackets or brackets affixed at an angle with respect to the light strands for wrapping around and mounting to an elongated cylindrical object, such as a tree or pole, along the length of the tree or pole.

BACKGROUND OF THE INVENTION

Light strands, particularly Christmas light strands, are well known in the art. It is common to wrap Christmas lights and other light strands around trees or poles for decorative aesthetic purposes. In fact, it is typically desirable to mount the light strands at an angle for a more appealing look, especially when trying to simulate a candy cane. However, mounting light strands around tall and elongated cylindrical objects, such as tree trunks and poles, can be cumbersome and difficult and particularly when mounting them at an angle along the length of the tree trunk. In fact, it is especially difficult when mounting multiple strands of different colored lights to achieve a desired look with respect to spacing and color coordination. Moreover, to properly mount strands of lights around a tree or pole is time consuming and can be frustrating, especially when the strands slide or become dislodged. If there existed a light strands mounting device or system that made it more convenient and reliable and less time consuming to mount strands of lights around a tree or pole, it would be well received. Unfortunately, there are no known light strands mounting devices or systems that adequately address or resolve these shortcomings in the background art.

For instance, U.S. Pat. No. 8,251,543 ("the '543 Patent") discloses a mounting module for a rope light system which attaches to the surfaces of an interior corner of a structure, not a tree or pole, that can retain and support a rope light without the need of a junction or brake in the rope light by holding the rope light in a flexure curve that does not stress the LEDS or electrical conductors of the rope light.

U.S. Pat. No. 7,014,331 ("the '331 Patent") discloses a light system to be installed under branches of a tree, particularly under the fronds of a palm tree, but not around the trunk of a tree. The system involves a flexible multiple bulb light rod or a continuous string of lights. A lower end of the light rod is installed to a trunk of a tree by way of a bracket. The upper end of the flexible light rod has one end of a cord attached thereto. The cord is passed along the light rod by way of hooks attached thereon. By pulling at the other free end of the cord the flexible light rod will be bent downwardly to simulate the curvature of a branch on the tree without being attached thereto. The free end of the cord is then tied to a lower end of the bracket. The support rod for the lighting string may be supported on both ends on individual columns to form an arch. The light system disclosed in the '331 Patent is merely designed for installing lights under the branches of a tree and not to and around a tree trunk or pole.

U.S. Pat. No. 6,685,340 ("the '340 Patent") discloses an outdoor decoration, primarily intended for the holiday season, with a wire frame that is divided into segments, the segments having either the same size or with as many segments as possible having the same size, the segments not having the same size to be comparative in size, to permit fitting the segments together for convenient shipping. The segments are held together by clips and lights are placed on the frame. The '340 Patent, however, discloses an apparatus that is not adapted for mounting around and along the length of a tree trunk or pole.

U.S. Pat. No. 6,527,413 ("the '413 Patent") discloses a device and method for decorating cylindrical structures, such as the trunks of outdoor trees, poles and the like consisting of a lighting assembly including a pair of substantially parallel and rigid hollow side members. A light string is disposed through both side members to provide a series of parallel light runs. The two tubular side members are reversibly affixable to one another using one or more fasteners. Male and female plug connectors are provided for the light string so that like lighting assemblies may be reversibly secured to one another. In operation, the lighting assembly is disposed alongside a tree trunk, lighting pole or similar cylindrical structure in a substantially vertical orientation. The two side members are then translated about opposite sides of the cylindrical structure so that the light runs are cause to surround the cylindrical structure. The side members are reversibly connected together. Multiple lighting assemblies may be electrically affixed to one another so that a series of cylindrical objects may be decorated. The '413 Patent, however, discloses a lighting assembly that is not adapted for adequately and conveniently mounting a plurality of light strands at an angle along the length of a tree trunk or pole and is not adaptable to trees and poles of different circumferences without customizing the length of the light strands for each tree or pole.

U.S. Pat. No. 6,203,171 ("the '171 Patent") discloses an apparatus for attachment to a permanent object to enable a unitary lighting display between apparatus and permanent object. The present invention includes a shaft member adapted to extend along at least a portion of the object, and a structural member attached to the shaft member. The structural member is configured to extend at least partially around the permanent object so as to enable the apparatus to be fitted around the permanent object. The apparatus is adapted to mount a lighting display integral in appearance with a lighting display on the permanent object to thereby enable the unitary lighting display. The '171 Patent, however, discloses an apparatus that is not adapted for adequately and conveniently mounting a plurality of light strands at an angle along the length of a tree trunk or pole and is not adaptable to trees and poles of different circumferences without customizing the length of the light strands for each tree or pole.

U.S. Pat. No. 4,462,065 ("the '065 Patent") discloses an apparatus and method for decoratively lighting an outdoor tree, the apparatus comprising an elongate tubular member adjustably mounted on the trunk portion of a tree by tree mounting brackets, the elongate tubular member having a light branch receiving bracket mounted at the upper end thereof which removably receives a plurality of light branches therein in non-rotating relationship therewith, each lighting branches being constructed from an elongate rod member having an electric cord extending there along with a plurality of light sockets attached thereto with electric bulbs received therein, the electric cord being secured to the rod with tubular conduit and adhesive wrap, each light branch exterior surface being coated with a high strength coating material having glitter therein, each branch electric cord being removably connected to a central electric cord within the tubular member, the light branches being positioned within the branch area of a tree to provide a lighting pattern therein. The '065 Patent discloses an apparatus that is specifically designed for mounting to branches of a tree and not to mounting around the trunk of a tree at an angle with multiple light strands of varying lengths. The '065 Patent also is not adapted for mounting to any size tree of different circumferences.

U.S. Publication No. 2016/0146410 ("the '410 Publication") discloses a tree lighting system for quickly installing lights on a tree. The system includes a tree lighting assembly wherein the tree lighting assembly includes a tiered, cone-shaped net extending between a first ring and a second ring. The net supports a plurality of lights thereon, whereby the diameter of the second ring is larger than that of the first ring. This allows the tree lighting assembly to have a hollow interior volume when the net is expanded into its conical shape. The tree lighting assembly is placed over a tree, whereby the body of the tree is disposed within the interior volume of the tree lighting assembly. The device disclosed in the '410 Publication is not designed for mounting to a tree trunk or pole.

U.S. Publication No. 2008/0291662 ("the '662 Publication") discloses a lighting system that includes a plurality of circular or disk-shaped lighting rings suitable for installation on a Christmas tree. The lighting rings include lights affixed to a webbing or net, and slits and trunk apertures to facilitate their placement around the Christmas tree trunk. For connection to an electrical power source, the lighting rings include electrical connectors including female electrical and male electrical connectors. The system disclosed in the '662 Publication is not designed for mounting to a tree trunk or pole.

U.S. Publication No. 2007/0041189 ("the '189 Publication") discloses devices and methods which allow rapid and convenient mounting, aligning and patterning strings of decorative light bulbs and Light Emitting Diodes (LEDs) on flat surfaces, curved surfaces, generally cylindrical structures such as the trunks of outdoor and indoor trees, branching objects such as branching tree structures and the like. The included devices include 1 or a plurality of flexible holiday decorative lighting mounting strips and various types of mounting devices as required. Light covers might be used to cover and darken lights that disrupt patterns. A single decorative lighting attachment strip can be used to position and align lights on a roughly cylindrical object. A multitude of decorative lighting attachment strips may be used to allow wrapping strings of decorative lights about a roughly cylindrical or branched object in a decorative pattern, which can encircle the entire circumference of the object or a portion thereof. A multitude of decorative lighting strips may be used to affix strings of decorative lights to flat or curved surfaces. The '189 Publication, however, discloses a process that is not adapted for adequately and conveniently mounting a plurality of light strands at an angle along the length of a tree trunk or pole and is not adaptable to trees and poles of different circumferences without customizing the length of the light strands for each tree or pole.

U.S. Publication No. 2004/0136191 ("the '191 Publication") discloses a decorative lighting system, having a flexible net to be placed over a wall, tree, or bush, allowing an electrical current to pass through and illuminate Christmas or holiday lights placed randomly along the net. The '189 Publication, however, discloses a light net that also is not adapted for adequately and conveniently mounting a plurality of light strands at an angle along the length of a tree trunk or pole and is not adaptable to trees and poles of different circumferences without customizing the length of the light strands for each tree or pole.

The foregoing patent references fail to disclose a decorative lighting system or process that includes a plurality of light strands that can be securely mounted to a tree trunk or pole of any circumference quickly and conveniently at any angle along the length of the tree trunk or pole. Moreover, it appears that none of the cited references could be combined to suggest, motivate or disclose the instant invention disclosed herein. It is therefore desirable to have a decorative light device and system having a plurality of light strands that can be quickly, conveniently and efficiently mounted to a tree trunk or pole of any circumference or shape and any desired angle. If there existed a device or system having these attributes it would address the shortcomings in the background art. As there are no known decorative light devices or systems known that can be quickly, conveniently and efficiently mounted to any size tree or pole at varying angles, there exists a need for such a device or system. It is, therefore, to the effective resolution of the aforementioned problems and shortcomings of the prior art that the present invention is directed. The instant invention addresses this unfulfilled need in the prior art by providing a decorative lighting device and system as contemplated by the instant invention disclosed herein.

SUMMARY OF THE INVENTION

In accordance with one aspect, the present invention provides a decorative lighting device including at least two strands of lights joined together at opposite ends by a first bracket and a second bracket wherein the light strands are attached to the first and second bracket by corresponding fasteners at an angle that is less than or more than ninety degrees, depending on the reference point with respect to the brackets, such that the lighting device can be wrapped around a tree trunk or pole at an angle with respect to the support structure along the length of the tree trunk or pole wherein the first and second brackets are secured to the tree trunk or pole by fasteners, such as Velcro straps, nails, screws, adhesives, string or rope. The light strands are preferably waterproof. The brackets and fasteners preferably have a color that conceals their presence.

In another aspect, the present invention provides a decorative lighting device including a plurality of light strands joined together at opposite ends by a first bracket and a second bracket, respectively, and at least one intermediate bracket disposed between the first and second brackets, wherein the light strands are attached to the first, second and intermediate brackets by corresponding fasteners at an angle that is less than or more than ninety degrees, depending on the reference point with respect to the brackets, such that the lighting device can be wrapped around a tree trunk or pole at an angle with respect to the brackets and tree trunk or pole along the length of the tree trunk or pole wherein the brackets are secured to the tree trunk or pole by fasteners, such as Velcro straps, nails, screws, adhesives, string or rope. The light strands preferably include lighting elements, such as LED's or light bulbs, having at least two different colors. The light strands are waterproof and are secured to the brackets by fasteners, such as tie wraps, staples, clips or adhesives. The brackets and fasteners preferably have a camouflaging color that conceals their presence.

In an additional aspect, the present invention provides a decorative lighting system including a plurality of light strands joined together at opposite ends by a first bracket and a second bracket, respectively, and a plurality of intermediate wood or plastic brackets disposed between the first and second brackets, wherein the light strands are attached to the first, second and intermediate brackets by staples, tie wraps, clips or adhesive at an angle that is less than or more than ninety degrees, depending on the reference point with respect to the brackets, such that the lighting device can be wrapped around a tree trunk or pole at an angle with respect to the tree trunk or pole along the length of the tree trunk or pole wherein the brackets are secured to the tree trunk or pole by fasteners, such as Velcro straps, nails, screws, adhesives, string or rope. The light strands preferably include lighting elements, such as LED's or light bulbs, having at least two different colors, wherein each light strand is composed of light sources having the same color and preferably alternating between red lights sources on one or more strands and white light sources on one or more other strands such that the decorative light system displays red and white lighted bands around and along the length of the tree trunk or pole. The light strands are water proof and the brackets and fasteners preferably have a camouflaging color that conceals their presence.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
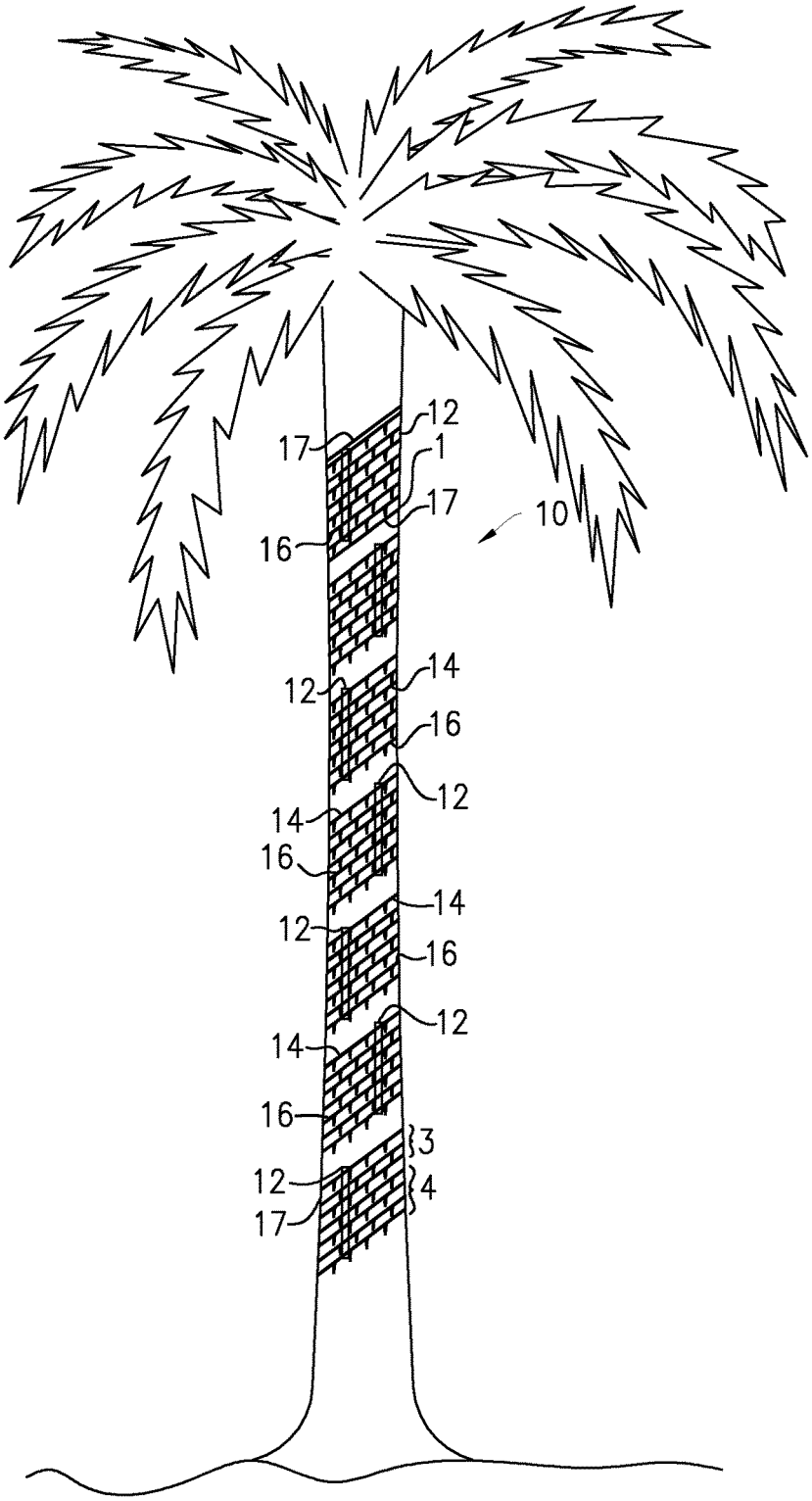
FIG. 1 is front elevational view of the decorative lighting device mounted to a tree trunk in accordance with the principles of the present invention.
Figure 2:
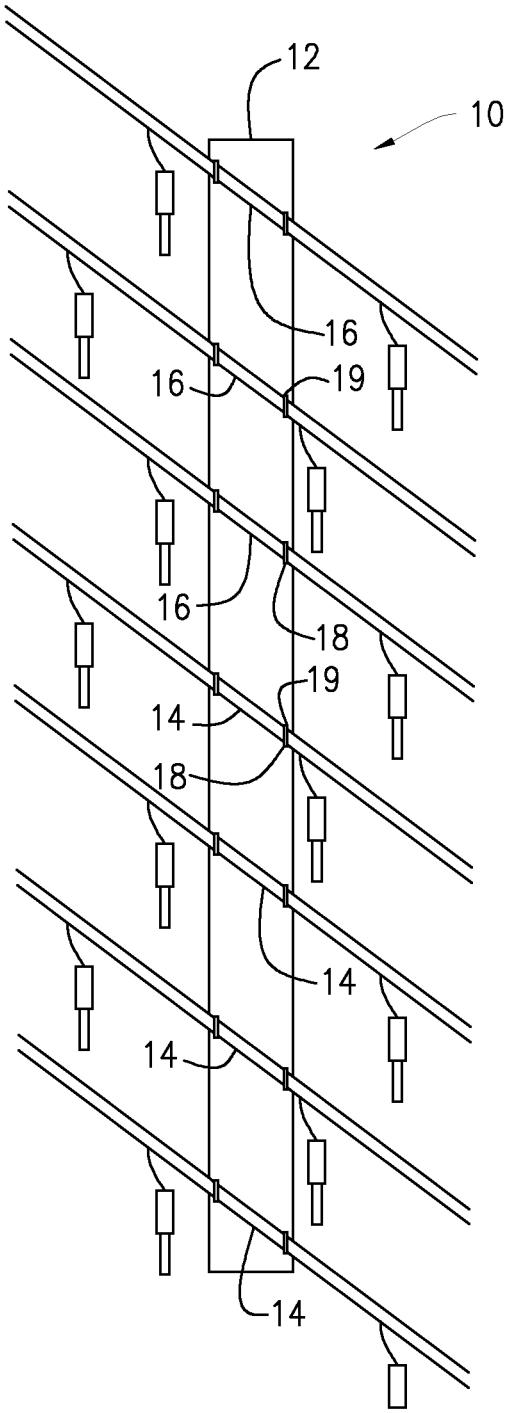
FIG. 2 is an elevational diagram view illustrating the manner in which two strands having different colored lights are attached to a bracket and shown mounted to a tree in FIG. 1 in accordance with the principles of the present invention and FIG. 3 is front perspective view of the decorative lighting device of FIG. 1 showing light strands attached to a plurality of brackets at angle in accordance with the principles of the present invention.
Figure 3:
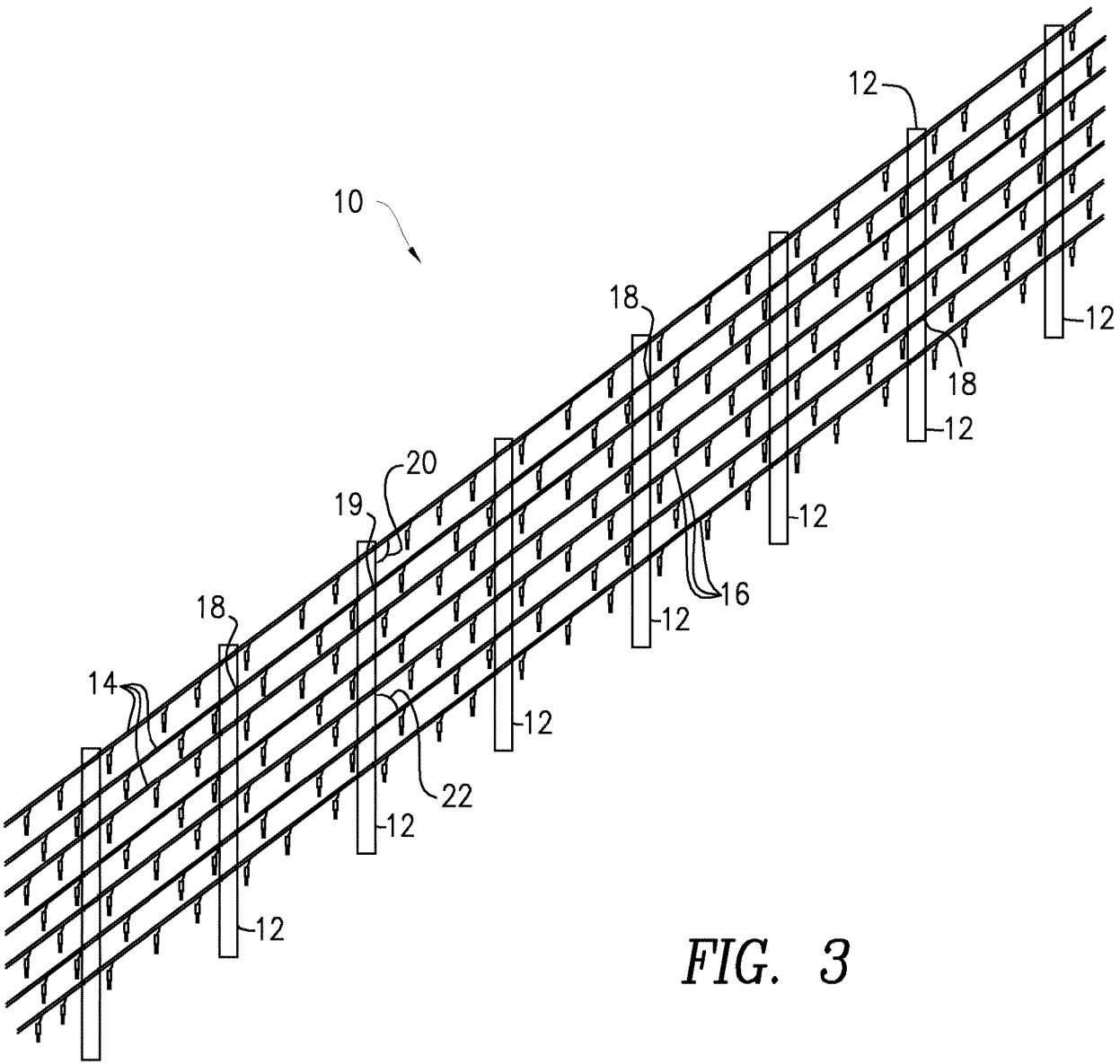

With reference to the drawings in which like reference designators refer to like elements, FIGS. 1 to 3 depict the preferred and alternative embodiments of the instant invention which is generally referenced as a decorative lighting device, lighting device, light device and, or by numeric character 10. There is shown in FIGS. 1-3 a decorative lighting device 10 and mounting method in accordance with the instant invention 10 that is designed for quick and convenient installation and mounting of light strands 14, 16 on curved or cylindrical surfaces or support structures, such as tree trunks, tree branches, columns and poles. The lighting device 10 includes a system having a plurality of light strands 14, 16 mounted to at least two brackets 12 at opposite ends of the strands 14, 16 and preferably multiple brackets 12 along the length of the strands 14, 16. The strands 14, 16 are connected to the brackets 12 by fasteners 18, such as staples, ties, tie wraps or adhesive, with approximately 1.5 inches between strands. The brackets 12 are positioned laterally with respect to the strands and spaced approximately twenty eighteen (18) inches apart, but the spacing may vary without departing from the scope and spirit of the instant invention 10. The brackets 12 are preferably made of plastic or wood and are approximately 1.5×10.5×0.25 inches. The dimensions of the brackets 12 may vary without departing from the scope and spirit of the instant invention 10. The light strands 14, 16 may comprise different colors, a plurality of colors or a single color.

Referring to FIG. 1, in the preferred embodiment the decorative lighting device 10 includes a first set of light stands 14 having a first color, such as red, a second set of light strands 16 having a second color, such as white, at least a first bracket 12 at one end of the light strands 14, 16, and a second bracket 16 at the opposite end of the light strands 14, 16. The lighting device 10 is a system of light strands 14 and, or 16 and brackets 12 that facilitate convenient mounting to a tree 1 or pole, and preferably includes at least one or more intermediate brackets 12 positioned between the brackets 12 at each end of the light strands 14, 16. The instant invention 10 also includes the process or method for mounting the light system 10 to a support structure. The end brackets 12, i.e. the first and last brackets 12, are preferably secured to the support structure 1 by hook-and-loop (Velcro®) straps 17, but may be secured by alternative fasteners, such as cable ties, nails or staples. Adjacent brackets 12 are preferably offset vertically, such as by about half an inch, when secured to the support structure 1 such that the strands 14, 16 are oriented at approximately a 145°/35° angle. The strand angles may vary in degrees by adjusting the offset of the light strands 14, 16. As the light strands 14, 16 are affixed or attached to the brackets 12, the strands 14, 16 dictate the positioning of the brackets 12 on the support structure 1. The light strands 14, 16 preferably comprise light emitting diodes (LED's), but may consists of light bulbs or other light sources known in the art. In one embodiment, four adjacent strands 16 illuminate or display white light and three adjacent light strands display red light 14 to simulate a candy cane appearance. The dimensions, angles, numbers and colors may vary without departing from the scope and spirit of the instant invention 10.

With reference to FIG. 2, the decorative lighting device 10 has a plurality of light strands 14, 16 that are affixed to a bracket 12 as shown. The light strands 14, 16 are secured to each bracket 12 with a fastener which is preferably a staple or tie wrap. When using tie wrap fasteners 18, the brackets 12 having a plurality of apertures 19 for passing the tie wraps 18 which are spaced apart to achieve the desired angle. The apertures 19 are not required when using staples as a fastener 18, however, tie wraps or other types of ties 18 and apertures 19 are preferred for consistency with and dictating the angle of the light strands 14, 16. The distance between the upper and lower cooperating apertures 19, which are on opposite sides of the bracket 12, determines the angle of the light strands 14, 16 when mounted to a tree 1 or other support structure. In the preferred embodiment, the distance between the upper and lower opposing apertures 19 is approximately a half inch (0.5 inches). The placement of the apertures 19 also dictates the spacing between the light strands. The distance between apertures 19 on the same side of the bracket 12 determines the spacing between adjacent segments of a light strand or adjacent light strands 14 or 16. In the preferred embodiment, the distance between adjacent apertures 19 on the same side of a bracket 12 is approximately one and a half inches (1.5 inches), as shown in FIG. 2. In the preferred embodiment, the brackets 12 are approximately 10.5 inches long and the apertures 19 are spaced to achieve a light strand angle of approximately 145/35 degrees, depending on the reference point for measuring the angle.

Now referring to FIG. 3, the lighting device 10 is shown in a diagram to illustrate the spacing between brackets 12 and the angle of the light strands 14, 16 with respect to the brackets 12. A first angle 20 is preferably less than ninety (90) degrees while the opposing second angle 22 is consequently greater than ninety (90) degrees. Accordingly, if the first angle is 35 degrees then the second angle is 145 degrees. The first and second angles 20, 22 may vary to achieve a desired look without departing from the scope and spirit of the instant invention 10. As shown in FIG. 3, the brackets 12 are preferably spaced eighteen (18) inches, or 1.5 feet, apart, but may be closer or further apart in spacing. While the lighting device 10 may be mounted to a tree trunk 1 or other support structure with only end brackets 12, a plurality of intermediate brackets 12 between the end brackets 12 are preferred for stability and consistency in the angular positioning of the light strands 14, 16. The strand fasteners 18 are also shown in FIG. 3 and preferably include ties or tie wraps 18 secured through apertures 19. In an alternative embodiment, the fasteners 18 may be staples 18 or other known fasteners. The light strands 14, 16 having male and female electrical plugs at either end and can be connected to other light strand devices 10.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A decorative lighting device for wrapping around an elongated support structure, such as a tree or pole, comprising:

a first elongated bracket;

a second elongated bracket;

at least one light strand expanding between and affixed to said first bracket and said second bracket at a predetermined angle with respect to said first and second brackets, said first bracket and said second bracket forming an obtuse or acute angle with said at least one light strand and being parallel and separated, by a predetermined distance to each other along different lines for mounting said light strand around and along the support structure at a predetermined angle;

a plurality of first light sources electrically and mechanically supported by said light strand;

light strand securing means for securing said light strand to said first and second brackets; and bracket mounting means for mounting said first and second brackets to and around the support structure.

2. A decorative lighting device as recited in claim 1, wherein said device further comprises:

at least one intermediate bracket positioned between said first and second brackets, said light strand being affixed to said intermediate bracket, said intermediate bracket being parallel to said first bracket and said second bracket and a predetermined distance and along a different line from said first and second brackets.

3. A decorative lighting device as recited in claim 1, wherein said device further comprises:

a second light strand expanding between and affixed to said first and second brackets, said second light strand having a plurality of second light sources electrically and mechanically supported by said second light strand.

4. A decorative lighting device as recited in claim 3, wherein said first and second light sources comprises different colors.

5. A decorative lighting device as recited in claim 1, wherein said device further comprises:

a plurality of light strands expanding between and affixed to said first and second brackets, said plurality of light strands having a plurality of light sources electrically and mechanically supported by said plurality of light strands.

6. A decorative lighting device as recited in claim 5, wherein said device further comprises:

at least one intermediate bracket positioned between said first and second brackets, said at least one light strand and said plurality of light strands being affixed to said intermediate bracket.

7. A decorative lighting device as recited in claim 5, wherein said device further comprises:

a plurality of intermediate brackets positioned between said first and second brackets, said at least one light strand and said plurality of light strands being affixed to said plurality of intermediate brackets.

8. A decorative light device as recited in claim 1, wherein said predetermined angle is other than ninety degrees.

9. A decorative light device as recited in claim 1, wherein said predetermined angle is more than ninety degrees.

10. A decorative light device as recited in claim 1, wherein said predetermined angle is less than ninety degrees.

11. A decorative light device as recited in claim 1, wherein said light strand securing means comprises at least one tie wrap.

12. A decorative light device as recited in claim 1, wherein said light strand securing means comprises at least one staple.

13. A decorative light device as recited in claim 1, wherein said light strand securing means comprises at least one clip.

14. A decorative light device as recited in claim 1, wherein said light strand securing means comprises an adhesive.

15. A decorative light device as recited in claim 1, wherein said bracket mounting means comprises at least one hook-and-loop strap.

16. A decorative light device as recited in claim 1, wherein said bracket mounting means comprises at least one strap.

17. A decorative light device as recited in claim 1, wherein said bracket mounting means comprises nails.

18. A decorative light device as recited in claim 1, wherein said light sources comprise light emitting diodes.

19. A decorative light device as recited in claim 18, wherein said light emitting diodes comprise at least two different colors.

20. A decorative light device as recited in claim 1, wherein said light sources comprise light bulbs.

* * * * *